US011436898B1

(12) United States Patent
Oliveira et al.

(10) Patent No.: US 11,436,898 B1
(45) Date of Patent: Sep. 6, 2022

(54) HYBRID FRAUD DETECTION SYSTEM AND METHOD

(71) Applicant: NCR Corporation, Duluth, GA (US)

(72) Inventors: Vinicius Galvão Cardinali Oliveira, Osasco (BR); Mauricio Cravcenco Anibal, São Paulo (BR); Rafael Vinicius Pita, São Bernardo do Campo (BR); Mauricio David, São Paulo (BR); Felipe Lopes Rodrigues dos Santos, São Paulo (BR)

(73) Assignee: NCR Corporation, Atlanta, GA (US)

( * ) Notice: Subject to any disclaimer, the term of this patent is extended or adjusted under 35 U.S.C. 154(b) by 0 days.

(21) Appl. No.: 17/216,957

(22) Filed: Mar. 30, 2021

(51) Int. Cl.
*G07F 19/00* (2006.01)

(52) U.S. Cl.
CPC ..... *G07F 19/2055* (2013.01); *G07F 19/207* (2013.01)

(58) Field of Classification Search
CPC ..... G07F 7/0873; G07F 19/20; G07F 19/201; G07F 19/205; G07F 19/2055
USPC ..... 235/379
See application file for complete search history.

(56) References Cited

U.S. PATENT DOCUMENTS 6,390,367 B1 * 5/2002 Doig ..... G07F 19/20 235/436
8,348,162 B2 * 1/2013 Xiao ..... G07F 19/2055 235/487
8,523,072 B2 * 9/2013 Randolph ..... G06K 7/084 235/380
2007/0040023 A1 * 2/2007 Ruggirello ..... G07F 19/20 235/382
2014/0158768 A1 * 6/2014 Ray ..... H04K 3/825 235/449

OTHER PUBLICATIONS

VL6180X data sheet, Proximity and ambient light sensing (ALS) module, Mar. 2016, STMicroelectronics.

* cited by examiner

*Primary Examiner* — Suezu Ellis
(74) *Attorney, Agent, or Firm* — Mandelbaum Silfin Economou LLP; John S. Economou

(57) ABSTRACT

A fraud detection system for a self-service terminal which has a card reader includes an optical proximity sensor and an electrode for a capacitive proximity sensor mounted adjacent to a slot in the card reader. A controller is coupled to the optical proximity sensor and the capacitive proximity sensor. The controller compares a proximity signal from the optical proximity sensor with a first predetermined proximity threshold that is adjusted based on a level of ambient infrared light at that sensor, and sets an alarm signal when an object is closer than the adjusted first predetermined proximity threshold. The controller also compares a proximity signal from the capacitive proximity sensor with a second predetermined proximity threshold that is adjusted based on a level of luminosity light at the optical proximity sensor, and sets an alarm signal when an object is closer than the adjusted second predetermined proximity threshold.

20 Claims, 5 Drawing Sheets

HYBRID FRAUD DETECTION SYSTEM AND METHOD

FIELD

This disclosure relates to an improved fraud detection system and method for use with self-service terminal equipment, such as automatic teller machines and gas pumps, that reads information from an encoded magnetic stripe or chip card.

BACKGROUND

Unauthorized reading of card data, such as data encoded on a magnetic stripe of a customer' debit or credit card, while the card is being used ("card skimming"), is a known type of fraud. Card skimming is most often done when a scammer adds a skimmer, i.e., an assembly including a separate magnetic read head, to the front fascia of a self-service terminal (e.g., an automated teller machine (ATM) or gas pump) which reads the magnetic stripe on the customer's card as the card is inserted or removed from the ATM or gas pump. Another type of fraud committed in conjunction with a data terminal having a card reader device is called "card trapping." In this type of fraud, a trapping device is inserted into the card slot in the card reader and when a user inserts their card into the slot, it becomes trapped and the user is not able to remove the card. Skimmers and trapping devices may be detected by optical sensors in an anti-skimming device mounted in, on, or adjacent to a card reader. However, external infrared light sources, such as sunlight, can often trigger false alarm conditions. An excessive number of false alarm conditions can be costly, as a technician visit is typically required to the location each time an alarm condition is generated.

Accordingly, there is a need for a fraud detection system and method which detects skimmers and trapping device without causing excessive false alarm conditions.

BRIEF DESCRIPTION OF THE DRAWINGS

The following detailed description, given by way of example and not intended to limit the present disclosure solely thereto, will best be understood in conjunction with the accompanying drawings in which.

CAPACITIVE DETAILED DESCRIPTION

In the present disclosure, like reference numbers refer to like elements throughout the drawings, which illustrate various exemplary embodiments of the present disclosure.

Figure 1A:
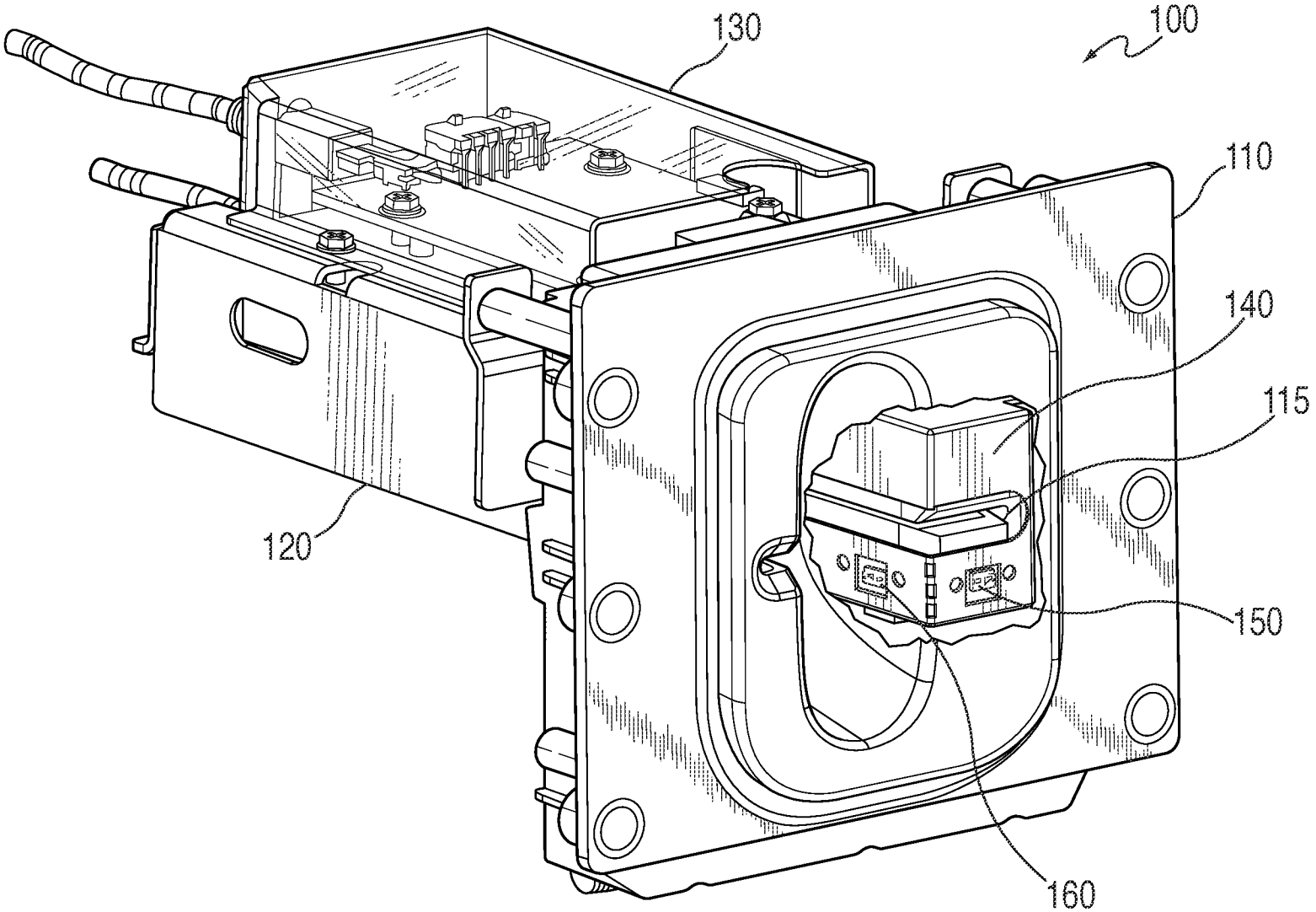
FIG. 1A is a front perspective view of a card reader assembly including a hybrid fraud detection system according to the present disclosure.
Figure 1B:
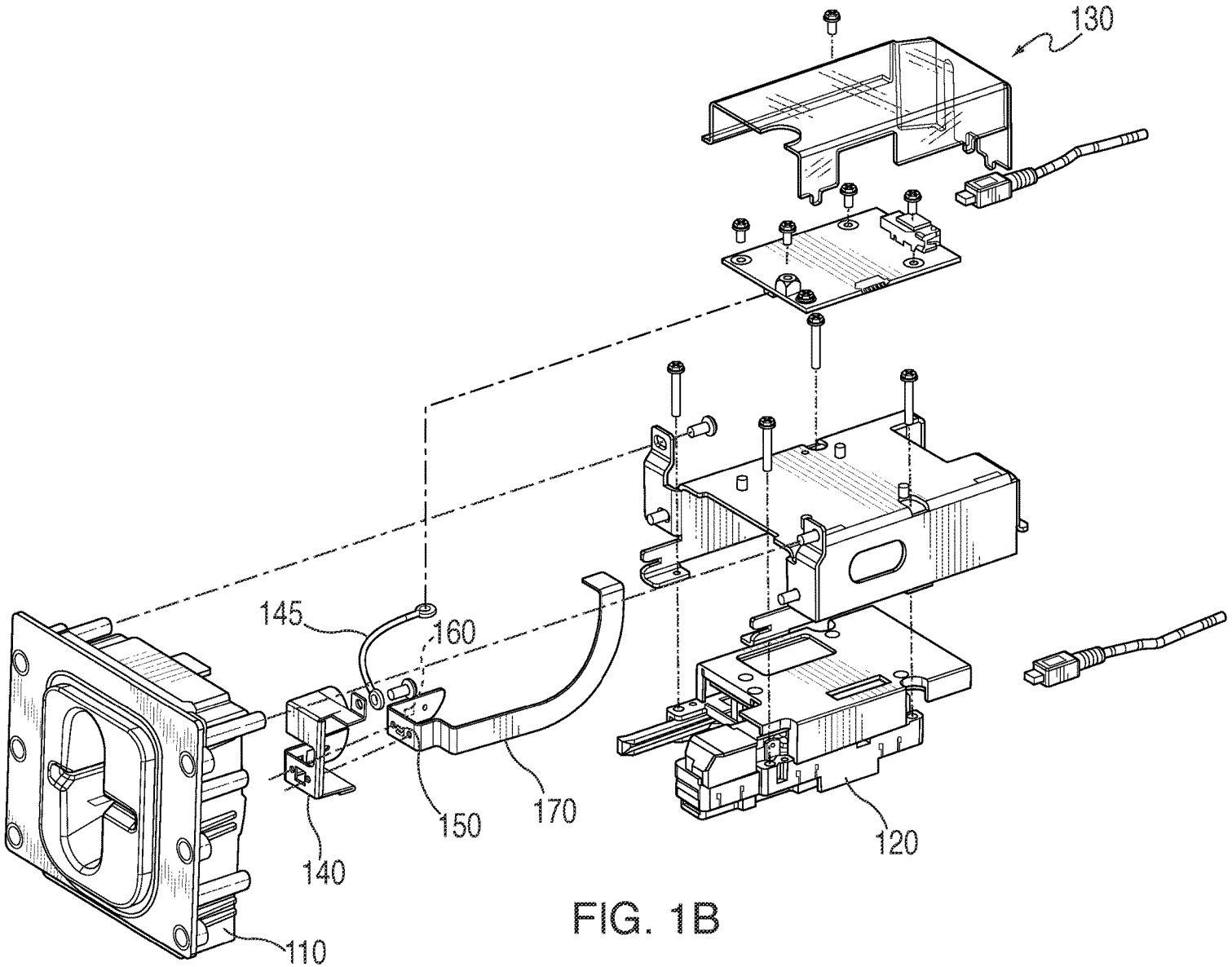
FIG. 1B is an exploded view of the card reader assembly of FIG. 1A.

The hybrid fraud detection system and method described in the figures and accompanying description below provide a resilient solution which is totally adaptive to the particular environment where it will be installed, effectively self-adjusting based on changing ambient conditions. Referring now to FIGS. 1A and 1B, an ATM typically includes a card reader module 120 mounted behind a bezel 110 that is front-facing and translucent. The card reader module 120 includes a slot 115 to accept a magnetic stripe or chip card, the slot 115 accessed via a comparable slot within the bezel 110. A scammer may attempt to install a card-skimming or card-trapping device over (or in) the slot 115 in order to either steal a user's account information or the user's card itself. The hybrid fraud detection system 100 of the present disclosure includes a control module 130, two optical proximity sensors 150, 160 and a capacitive electrode 140 for a capacitive proximity sensor placed between a front part of the card reader module 120 and the bezel 110. The optical proximity sensors 150, 160 and the capacitive electrode 140 are mounted adjacent to the slot 115 in the front of card reader module 120 and are coupled to the control module 130 for processing. As seen in FIGS. 1A and 1B, optical proximity sensor 150 is forward-facing to detect skimmers placed directly over bezel 110 and optical proximity sensor 160 faces toward a small inset front cavity in bezel 110. The capacitive proximity sensor consists of the capacitive electrode 140 which fits over both the front and side portions of the front part of card reader module 120 and associated processing circuitry in control module 130 that is connected to the capacitive electrode 140 via a wire 145. The capacitive proximity sensor detects skimmers or other objects placed on or adjacent to bezel 110. The two optical proximity sensors 150, 160 are preferably mounted on a flexible printed circuit assembly 170 for coupling to the control module 130, with the flexible printed circuit assembly 170 mounted over the front part of the card reader module 120.

Figure 2:
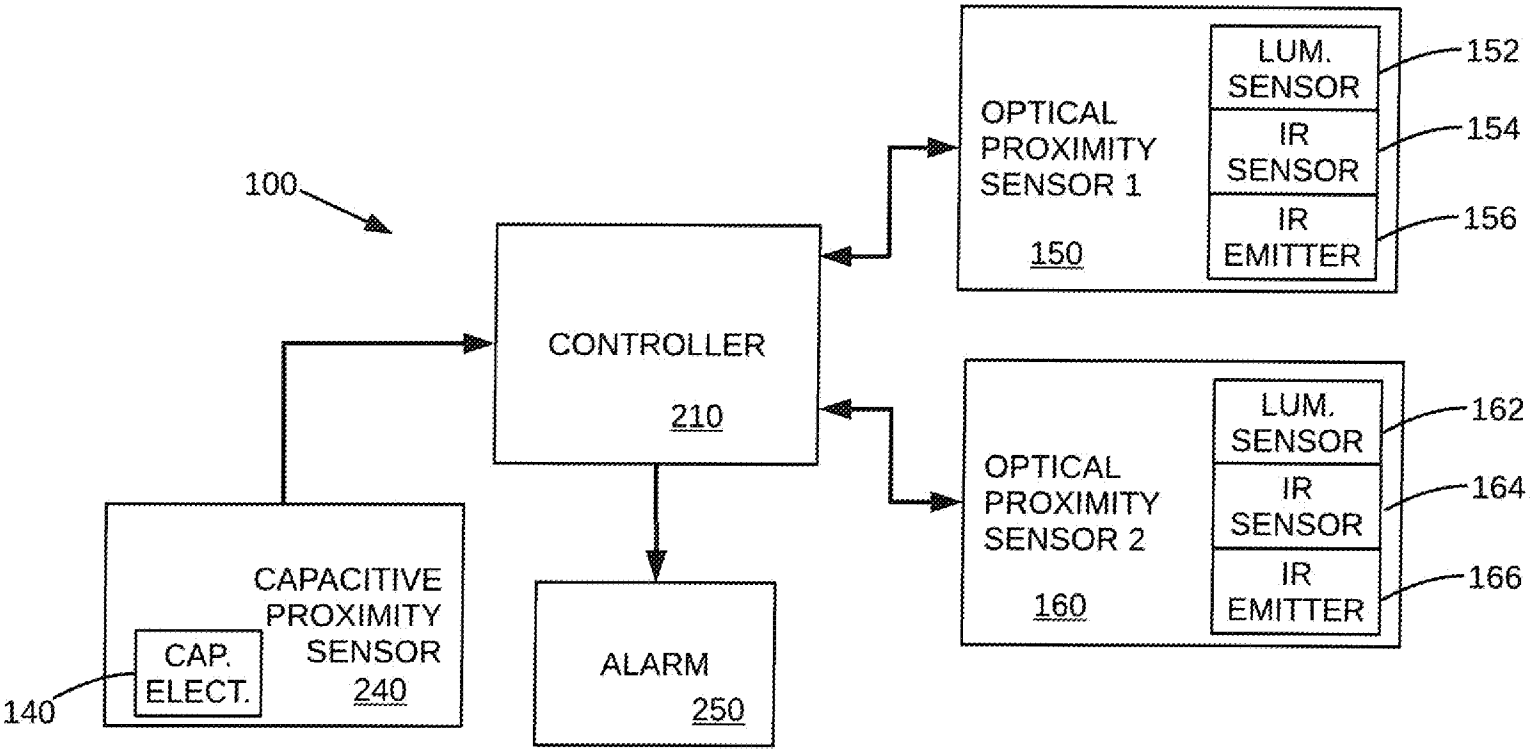
FIG. 2 is a block diagram of the hybrid fraud detection system shown in FIGS. 1A and 1B.

Referring now to FIG. 2, a block diagram of the hybrid fraud detection system 100 of FIG. 1 is shown. A capacitive proximity sensor 240 and two optical proximity sensors 150, 160 are each coupled to a controller 210 for processing. Controller 210 is also shown coupled to an alarm 250. Alarm 250 may be a physical device or a signal output to a higher level controller for the associated ATM.

Each optical proximity sensor 150, 160 includes an integral optical proximity sensor formed from an infrared (IR) emitter/receiver pair (i.e., IR emitter 156 and IR sensor 154, and IR emitter 166 and IR sensor 164) which preferably operate at 850 nm wavelength and an ambient light sensor 152, 162. The IR emitter/receiver pairs are used to determine a target proximity while the ambient light sensors 152, 162 each provide a signal corresponding to the ambient luminosity light level (i.e., a LUX signal) in an area directly adjacent to the associated optical proximity sensor 150, 160. The IR sensors 154, 164 also provide a signal corresponding to ambient IR noise (i.e., an ambient IR signal) in the area adjacent to the associated optical proximity sensor 150, 160. A device suitable for use for each optical proximity sensor 150, 160 is a proximity and ambient light sensing module, part no. VL6180X, from STMicroelectronics. The VL6180X device internally determines a range value by precisely measuring the time the light takes to travel to the nearest object and reflect back to the sensor (i.e., operates as a Time-of-Flight type optical proximity sensor) and also provides an output signal which corresponds to the measured light at the IR sensors 154, 164 during a measurement. This signal, an IR measurement signal, includes a component which is proportional to the amount of reflected IR light and a component corresponding to the ambient IR light (the ambient IR component) so that the actual measurement signal will be the IR measurement signal component less the ambient IR signal component. Other types of optical proximity sensors, e.g., sensors which estimate distance by measuring an amount of light reflected back from an object, may also be used. One of ordinary skill in the art will readily recognize that the amount of reflected IR light is inversely proportional to the distance to an object that reflects such light.

The forward-facing sensor, i.e., optical proximity sensor 150, is positioned to provide a signal used to detect when an object, such as a skimmer, has been placed over the front part of the bezel 110. The side-facing sensor, i.e., optical proximity sensor 160, is positioned to provide a signal used to detect when an object, such as a skimmer, has been placed inside the card area of bezel 110 where a customer inserts a magnetic stripe card. Each of the signals from the two optical proximity sensors 150, 160 provides an indication of the distance to an object (if any) located adjacent the associated sensor. A predetermined threshold distance for each optical proximity sensor 150, 160 will be established upon installation of the hybrid fraud detection system 100 (i.e., a distance from the associated sensor). Then, during operation, when the signal from the respective optical proximity sensor 150, 160 indicates that a detected object is closer than that predetermined threshold, it will be indicative that an object such as a skimmer has been positioned over the bezel 110 and an alarm signal can be generated. When the signal from the respective optical proximity sensor 150, 160 used for comparison to the predetermined threshold is the IR measurement signal, an alarm will be set when the IR measurement signal is greater than the predetermined threshold (indicating that a detected object is closer than that predetermined threshold). In some cases, a second predetermined threshold may be used to detect when an object has been placed directly over the output of optical proximity sensor 150, 160 (e.g., tape that absorbs light). In this case, the IR measurement signal can become negative because the measurement portion of the IR measurement signal will be less than the ambient IR signal. Thus, a second predetermined threshold with a negative value can be used to identify when a light-absorbing object has been placed directly over the optical proximity sensor 150, 160.

The capacitive proximity sensor 240 is a contactless sensor that includes, inter alia, a capacitive electrode 140. The capacitive proximity sensor 240 produces a signal that can be used to determine when an object moves closer than a predetermined distance of the capacitive electrode 140 based on a change in a total capacitance between the capacitive electrode and ground. A predetermined threshold distance for the capacitive proximity sensor 240 will be established upon installation of the hybrid fraud detection system 100 (i.e., a distance from that sensor) and when the signal from the capacitive proximity sensor 240 indicates that a detected object is closer than that predetermined threshold, it will be indicative that an object such as a skimmer has been positioned over the bezel 110 and an alarm signal can be generated. In the preferred embodiment, the capacitance of the capacitive proximity sensor 240 will increase as an object moves closer to the capacitive electrode 140, and thus the signal from the capacitive proximity sensor 240 will be inversely proportional to the distance between the capacitive electrode 140 and a detected object. This means that an alarm will be generated when the signal from the capacitive proximity sensor 240 exceeds the predetermined threshold.

In one alternative embodiment, the optical proximity sensor 160 may be omitted and only the optical proximity sensor 150 that is forward-facing and the capacitive proximity sensor 240 may be included. In another alternative embodiment, the system includes only the optical proximity sensor 150.

One problem faced in detecting objects placed over bezel 110 is the occurrence of false-positive signals. The inventors have found that one source of false positive signals when using optical and capacitive proximity sensors is the ambient condition at the bezel, including the amount of visible and infrared light. Excessive infrared light can affect the measurements generated by the optical proximity sensors 150, 160 and excessive visible light can affect the measurements generated by the capacitive proximity sensor 240 (e.g., direct sunlight can cause temperature changes on the capacitive electrode 140). The hybrid fraud detection system 100 compensates for these effects in order to significantly reduce the number of false positives signals.

Figure 3:
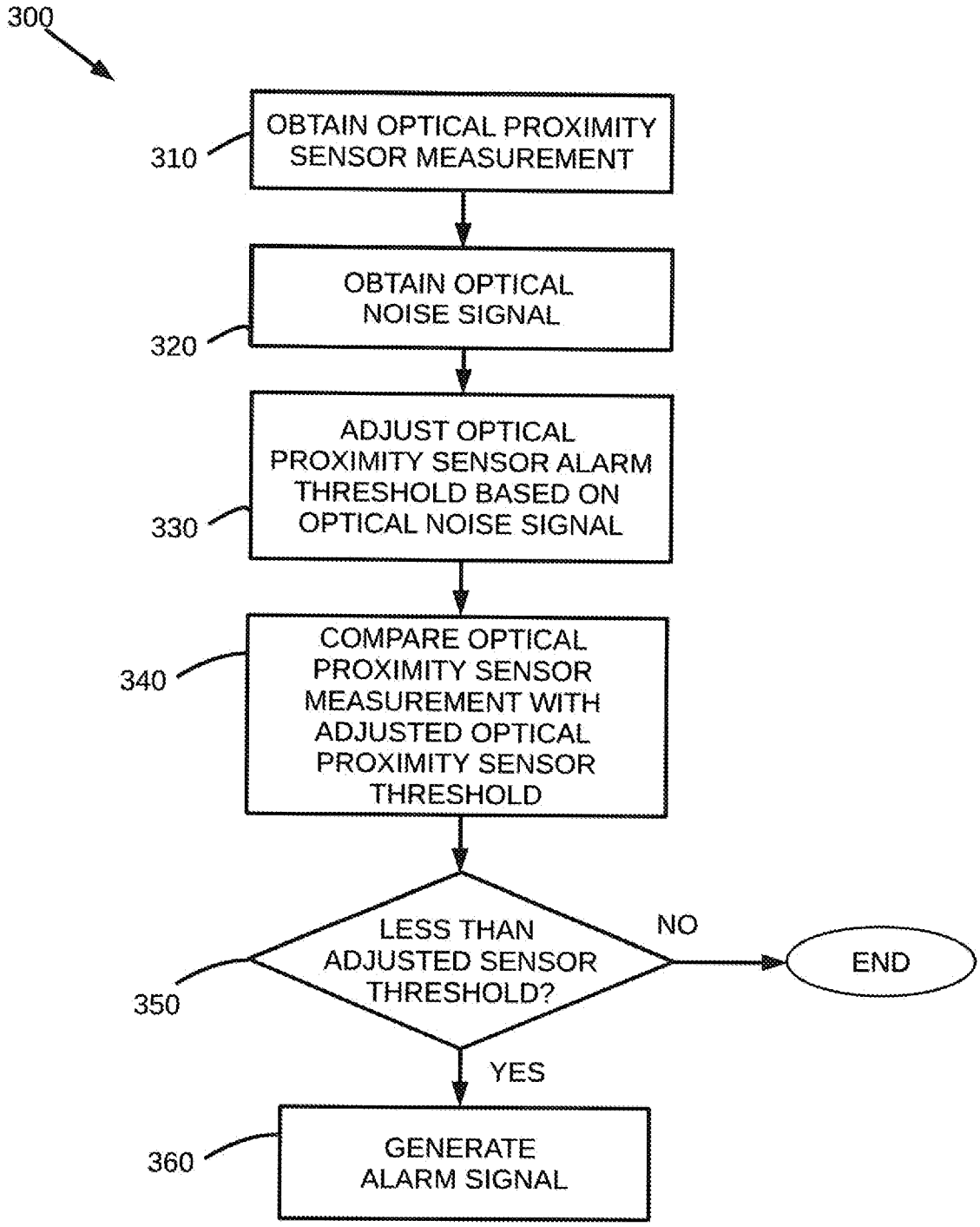
FIG. 3 is a flowchart showing the method of processing the measurements of the optical proximity sensors of the hybrid fraud detection system shown in FIGS. 1A and 1B.
Figure 4:
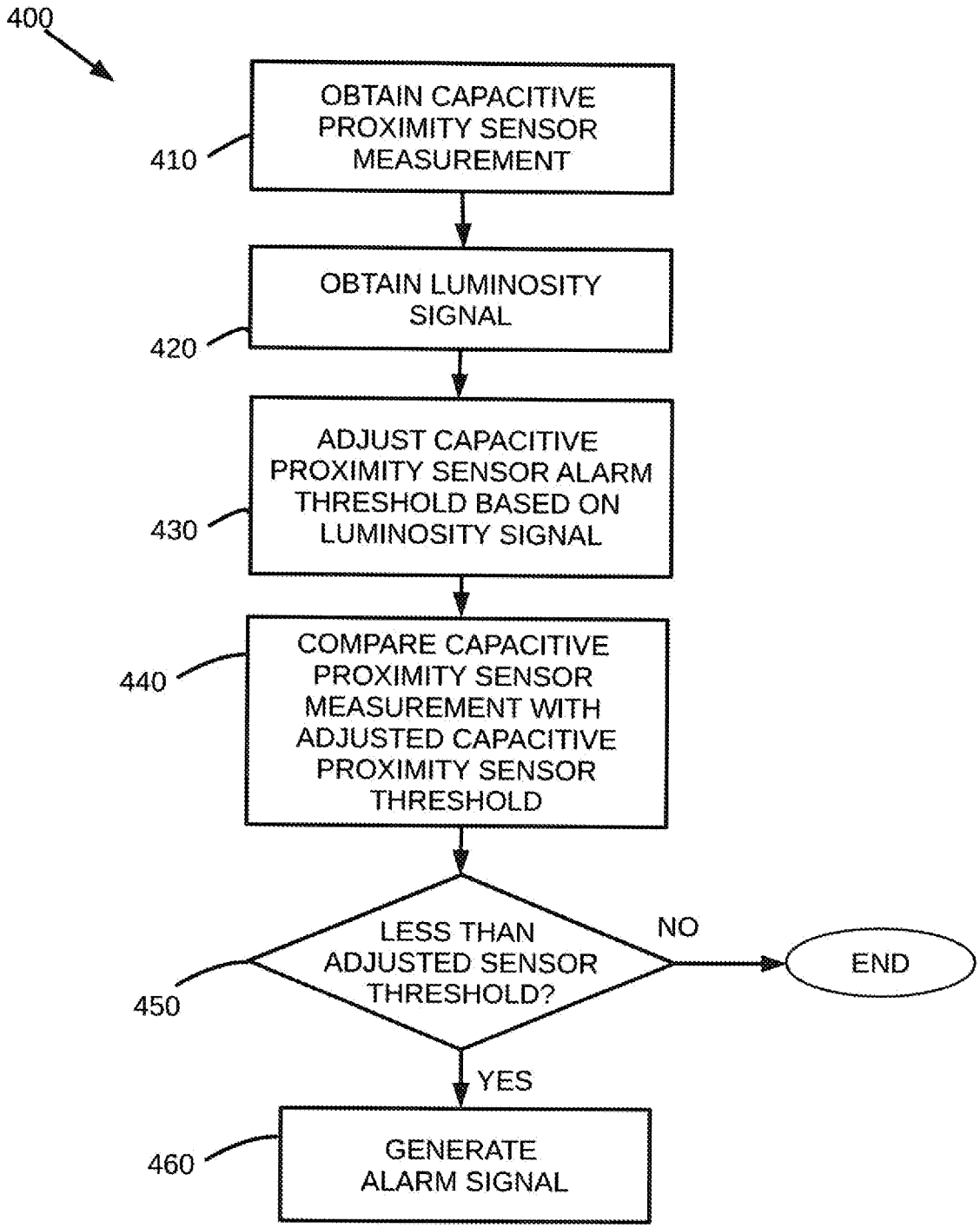
FIG. 4 is a flowchart showing the method of method of processing the measurement of the capacitive proximity sensor of the hybrid fraud detection system shown in FIGS. 1A and 1B.

In particular, as shown in the flowchart 300 of FIG. 3, the hybrid fraud detection system 100 adjusts the thresholds for each optical proximity sensor 150, 160 based on the actual environmental conditions in the area adjacent to the bezel 110. The process shown in FIG. 3 is repeated for each optical proximity sensor 150, 160. In a first step 310, the controller 210 obtains a measurement signal from the sensor. Next, at step 320, the controller 210 obtains an optical noise signal from that sensor (i.e., the ambient IR signal) and then uses that optical noise signal to adjust the optical proximity sensor alarm threshold at step 330. Controller 210 then compares the measurement signal with the adjusted alarm threshold at step 340. If the measurement signal is found to indicate an object that is closer to the respective optical proximity sensor 150, 160 than the adjusted threshold at step 350, an alarm signal is set at step 360. In Otherwise, current processing ends.

In addition, as shown in the flowchart 400 of FIG. 3, the hybrid fraud detection system 100 adjusts the thresholds for the capacitive proximity sensor 240 based on the actual environmental conditions in the area adjacent to the bezel 110 each time the sensor measurement is evaluated. In a first step 410, the controller 210 obtains a measurement signal from the capacitive proximity sensor 240. Next, at step 420, the controller 210 obtains a luminosity signal from optical proximity sensor 150 (i.e., the LUX signal) and then uses that luminosity signal to adjust the capacitive proximity sensor alarm threshold at step 430. Controller 210 then compares the measurement signal with the adjusted alarm threshold at step 440. If the measurement signal is found to indicate an object that is closer to the capacitive electrode than the adjusted threshold at step 450, an alarm signal is set at step 460. Otherwise, current processing ends.

The hybrid fraud detection system 100 continually loops and tests the two optical proximity sensors 150, 160 per the method shown in flowchart 300 and the capacitive proximity sensor 240 per the method shown in flowchart 400. By dynamically adjusting the alarm threshold associated with each sensor based on actual current environmental conditions, the hybrid fraud detection system 100 disclosed herein is able to provide significantly less false positive signals, thereby reducing maintenance costs (technician visits) for the associated ATM (or other type of self-service terminal). In particular, the hybrid fraud detection system 100 requires only one initial calibration to set a baseline threshold for each sensor and thereafter each threshold becomes dynamic, adjusted based on the changing ambient conditions in order to greatly reduce the incidence of false alarm signals. By greatly reducing or even eliminating the incidence of false alarm signals, the hybrid fraud detection system 100 of the present disclosure provides significant costs-savings both by reducing maintenance costs and by identifying and preventing actual fraud.

Although the present disclosure has been particularly shown and described with reference to the preferred embodiments and various aspects thereof, it will be appreciated by those of ordinary skill in the art that various changes and modifications may be made without departing from the spirit and scope of the disclosure. It is intended that the appended claims be interpreted as including the embodiments described herein, the alternatives mentioned above, and all equivalents thereto.

What is claimed is:

1. A fraud detection system for a self-service terminal having a card reader, comprising:

a first optical proximity sensor, the first optical proximity sensor outputting a first signal proportional to a proximity of an object to the first optical proximity sensor, a second signal proportional to a level of ambient infrared light in an area adjacent to the first optical proximity sensor, and a third signal proportional to a level of ambient luminosity light in the area adjacent to the first optical proximity sensor; and a controller coupled to the first optical proximity sensor and configured to receive the first signal from the first optical proximity sensor, receive the second signal from the first optical proximity sensor, adjust a first predetermined proximity threshold based on the second signal, compare the first signal from the first optical proximity sensor with the adjusted first predetermined proximity threshold, and set an alarm signal when the first signal from the first optical proximity sensor indicates that the object is closer to the first optical proximity sensor than the adjusted first predetermined proximity threshold.

2. The fraud detection system of claim 1, wherein the first optical proximity sensor is mounted adjacent to a slot in the card reader.

3. The fraud detection system of claim 1, wherein the first optical proximity sensor is mounted facing outwards away from the card reader.

4. The fraud detection system of claim 1, further comprising:

a capacitive proximity sensor having an electrode, the capacitive proximity sensor outputting a signal proportional to a proximity of an object to the electrode; and wherein the controller is coupled to the capacitive proximity sensor and is configured to receive the signal from the capacitive proximity sensor, receive the third signal from the first optical proximity sensor, adjust a second predetermined proximity threshold based on the third signal, compare the signal from the capacitive proximity sensor with the adjusted second predetermined proximity threshold, and set the alarm signal when the signal from the capacitive proximity sensor indicates that the object is closer to the electrode than the adjusted second predetermined proximity threshold.

5. The fraud detection system of claim 4, wherein the capacitive proximity sensor is mounted adjacent to a slot in the card reader.

6. The fraud detection system of claim 4, further comprising:

a second optical proximity sensor mounted adjacent to a slot in the card reader, the second optical proximity sensor outputting a first signal proportional to a proximity of an object to the second optical proximity sensor, and a second signal proportional to a level of ambient infrared light in an area adjacent to the first optical proximity sensor; and wherein the controller is coupled to the second optical proximity sensor and is configured to receive the first signal from the second optical proximity sensor, receive the second signal from the second optical proximity sensor, adjust a third predetermined proximity threshold based on the second signal from the second optical proximity sensor, compare the first signal from the second optical proximity sensor with the adjusted third predetermined proximity threshold, and set an alarm signal when the first signal from the second optical proximity sensor indicates that the object is closer to the second optical proximity sensor than the adjusted third predetermined proximity threshold.

7. The fraud detection system of claim 6, wherein the second optical proximity sensor is mounted adjacent to a slot in the card reader.

8. The fraud detection system of claim 6, wherein the second optical proximity sensor is mounted facing sideways towards a cavity in a bezel positioned over the card reader.

9. The fraud detection system of claim 1, wherein the signal from the first optical proximity sensor is inversely proportional to a distance to a detected object and wherein the controller sets the alarm signal when the signal from the first optical proximity sensor is greater than the adjusted first predetermined proximity threshold.

10. The fraud detection system of claim 9, wherein the signal from the first optical proximity sensor includes an ambient infrared (IR) component, and wherein the controller sets the alarm signal when the signal from the first optical proximity sensor is less than an adjusted second predetermined proximity threshold.

11. A method for detecting fraud at a self-service terminal having a card reader, comprising:

receiving a first signal from a first optical proximity sensor, the first signal proportional to a proximity of an object to the first optical proximity sensor;

receiving a second signal from the first optical proximity sensor, the second signal proportional to a level of ambient infrared light in an area adjacent to the first optical proximity sensor;

receiving a third signal from the first optical proximity sensor, the third signal proportional to a level of ambient luminosity light in the area adjacent to the first optical proximity sensor;

adjusting a first predetermined proximity threshold based on the second signal;

comparing the first signal from the first optical proximity sensor with the adjusted first predetermined proximity threshold; and setting an alarm signal when the first signal from the first optical proximity sensor indicates that the object is closer to the first optical proximity sensor than the adjusted first predetermined proximity threshold.

12. The method of claim 11, wherein the first optical proximity sensor is mounted adjacent to a slot in the card reader.

13. The method of claim 11, wherein the first optical proximity sensor is mounted facing outwards away from the card reader.

14. The method of claim 11, further comprising:

receiving a signal from a capacitive proximity sensor having an electrode, the signal proportional to a proximity of an object to the electrode;

adjusting a second predetermined proximity threshold based on the third signal from the first optical proximity sensor;

comparing the signal from the capacitive proximity sensor with the adjusted second predetermined proximity threshold; and setting the alarm signal when the signal from the capacitive proximity sensor indicates that the object is closer to the electrode than the adjusted second predetermined proximity threshold.

15. The method of claim 14, wherein the capacitive proximity sensor is mounted adjacent to a slot in the card reader.

16. The method of claim 14, further comprising:

receiving a first signal from a second optical proximity sensor, the first signal from the second optical proximity sensor proportional to a proximity of an object to the second optical proximity sensor;

receiving a second signal from the second optical proximity sensor, the second signal from the second optical proximity sensor proportional to a level of ambient infrared light in an area adjacent to the first optical proximity sensor;

adjusting a third predetermined proximity threshold based on the second signal from the second optical proximity sensor;

comparing the first signal from the second optical proximity sensor with the adjusted third predetermined proximity threshold; and setting an alarm signal when the first signal from the second optical proximity sensor indicates that the object is closer to the second optical proximity sensor than the adjusted third predetermined proximity threshold.

17. The method of claim 16, wherein the second optical proximity sensor is mounted adjacent to a slot in the card reader.

18. The method of claim 16, wherein the second optical proximity sensor is mounted facing side-ways towards a cavity in a bezel positioned over the card reader.

19. The method of claim 11, wherein the signal from the first optical proximity sensor is inversely proportional to a distance to a detected object and further comprising setting the alarm signal when the signal from the first optical proximity sensor is greater than the adjusted first predetermined proximity threshold.

20. The method of claim 19, wherein the signal from the first optical proximity sensor includes an ambient infrared (IR) component, and further comprising setting the alarm signal when the signal from the first optical proximity sensor is less than an adjusted second predetermined proximity threshold.

* * * * *